US005084069A

United States Patent [19]

Farng et al.

[11] Patent Number: 5,084,069

[45] Date of Patent: Jan. 28, 1992

[54] MULTIFUNCTIONAL ADDITIVES FOR LUBRICANTS AND FUELS

[75] Inventors: Liehpao O. Farng, Lawrenceville; Andrew G. Horodysky, Cherry Hill, both of N.J.

[73] Assignee: Mobil Oil Corporation, Fairfax, Va.

[21] Appl. No.: 600,888

[22] Filed: Oct. 22, 1990

[51] Int. Cl.[5] ..... C10L 1/26

[52] U.S. Cl. ..... 44/379; 558/164; 252/46.6

[58] Field of Search ..... 44/305, 375, 379; 252/46.6, 32.5; 558/164

[56] References Cited

U.S. PATENT DOCUMENTS

| | | | |
|---|---|---|---|
| 2,844,616 | 7/1958 | McDermott | 252/46.6 |
| 3,182,021 | 5/1965 | Asseff | 252/46.6 |
| 3,259,579 | 7/1966 | Rogers et al. | 558/164 |
| 3,544,465 | 12/1970 | Braid | 252/46.6 |
| 3,654,154 | 4/1972 | Braid | 252/46.6 |
| 3,755,501 | 8/1973 | Braid | 260/928 |
| 3,919,095 | 11/1975 | Okorodudu | 252/46.6 |
| 4,784,780 | 11/1988 | Farng et al. | 252/32.7 |
| 4,834,893 | 5/1989 | Doner et al. | 252/32.7 |

*Primary Examiner*—Jacqueline V. Howard

*Attorney, Agent, or Firm*—Alexander J. McKillop; Speciale, Charles J.; Jessica M. Sinnot

[57] ABSTRACT

A lubricant or fuel composition contains a multifunctional antioxidant and antiwear amount of an O,O-diorgano-S-(2-hydroxyalkyl) phosphorodithioate derived hydrogen phosphonate which can be made by reacting a diorganophosphorodithioic acid with an epoxide and a dialkyl phosphite, such as dimethyl phosphite.

29 Claims, No Drawings

MULTIFUNCTIONAL ADDITIVES FOR LUBRICANTS AND FUELS

FIELD OF THE INVENTION

This invention relates to automotive and industrial fluid compositions. Specifically, lubricants or fuels containing the reaction products of O'O-diorganophosphorodithioic acids, alkylene oxides and secondary phosphite esters.

BACKGROUND OF THE INVENTION

During the normal storage and usage of automotive and industrial lubricants, the lubricants are subject to high temperatures and oxygen which can lead to oxidation of the lubricants. Oxidized lubricants can cause the build up of oil-soluble acids, lacquers and sludge which can promote premature deterioration of engines and other lubricated systems.

Another problem associated with mechanical systems relates to the frictional forces created between relatively moving metal parts which can cause the wearing away of metal surfaces. An ability to reduce the coefficient of friction between these metal surfaces is not an inherent property of all lubricants.

Additionally, it is often found that lubricants are corrosive to certain metals, typically iron, copper, aluminum and lead, which are found in engines.

Additives are often blended with lubricants to inhibit oxidation of the lubricant as well as to prevent the wear and corrosion of metal parts. Phosphorodithioate compositions, i.e., the metal salts of phosphorodithioates, such as zinc dialkylphosphorodithioates, have been widely reported as multifunctional antiwear, peroxide decomposing and bearing corrosion inhibiting additives for industrial fluids. Further, organic phosphonates such as dibutyl hydrogen phosphonates and dioleyl hydrogen phosphonates have been described as antiwear and extreme pressure additives for lubricants.

SUMMARY OF THE INVENTION

It has now been found that products made by reacting an O'O-diorganophosphorodithioic acid with an alkylene oxide to form an intermediate which is then reacted with a secondary phosphite ester, i.e., dihydrocarbyl hydrogen phosphonate, are effective multifunctional antioxidant and antiwear additives with potential high temperature stabilizing and metal passivating properties as well as possible antifatigue, antiscuffing, metal deactivating, bearing corrosion inhibiting and cleanliness properties.

The invention is directed to a product having the formula

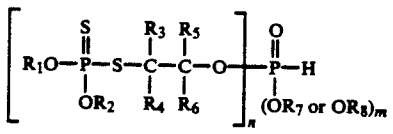

where $R_1$ and $R_2$ are hydrocarbyl radicals having 1 to 30 carbon atoms, $R_3$, $R_4$, $R_5$ and $R_6$ are, independently, hydrogen atoms or hydrocarbyl radicals containing 1 to 60 carbon atoms or which contain at least 1 heteroatom which is oxygen, sulfur or nitrogen, $R_7$ and $R_8$ are hydrocarbyl radicals containing 1 to 20 carbon atoms, n is an integer ranging from 1 to 2 and m is an integer ranging from 0 to 1 the sum of n and m being 2, automotive or industrial fluid compositions containing the product and methods of making the same. The invention is also directed to automotive or industrial fluid compositions containing a reaction product having multifunctional antioxidant and antiwear properties which is the reaction product of an O'O-diorganophosphorodithioic acid, an alkylene oxide and a phosphite ester.

The dithiophosphate substituted diorgano phosphite products of the present invention are formed in a transesterification reaction between an O'O-diorgano phosphorodithioate intermediate and a diorgano phosphite. The intermediate products, the O'O-diorgano phosphorodithioates, are formed in a reaction between a diorganophosphorodithioic acid and an alkylene oxide.

The diorganophosphorodithioic acid is prepared in a known reaction between a hydroxy compound and phosphorus pentasulfide. It is believed that the following equation is illustrative of the reaction mechanism:

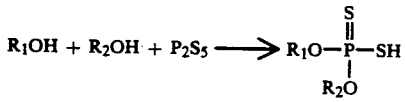

where $R_1$ and $R_2$ are hydrocarbyl radicals, typically aliphatic, aromatic or naphthenic or combinations thereof containing 1 to 30 carbon atoms, preferably from 2 to 20 carbon atoms. Representative examples of suitable hydroxy compounds are alcohols which include ethyl alcohol, propyl alcohol, n-butyl alcohol, isobutyl and sec-butyl alcohols, the isomeric primary and secondary amyl alcohols and mixtures thereof, the primary and secondary isomers of hexyl alcohol, cyclohexyl alcohol, the isomers of octyl alcohol, decyl alcohol, lauryl alcohol, benzyl alcohol, phenol, cresol, xylenol, naphthol, ethylphenol, butylphenol, nonylphenol and mixtures of the foregoing. The preferred alcohols are 4-methyl-2-pentanol and 2-ethyl-1-hexyl alcohol.

The alkylene oxide most suitable for preparing the intermediate product has the structural formula

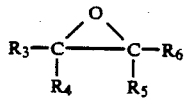

wherein $R_3$, $R_4$, $R_5$ and $R_6$ are hydrogen or hydrocarbyl containing from 1 to 60 carbon atoms and can additionally contain sulfur, oxygen and/or nitrogen. The contemplated hydrocarbyl can be either aliphatic, aromatic or naphthenic. Suitable oxides include ethylene oxide, propylene oxide, butylene oxide, cyclohexene oxide and styrene oxide.

The intermediate can be made in the presence of an inert organic solvent such as benzene, toluene or xylenes. The reaction mixture can be maintained between a temperature range of 0° C. to 100° C., from 30° C. to 80° C. is preferred. Preferably, the intermediates are contacted in equimolar amounts of acid to alkylene oxide and; thereafter, refluxed to insure complete reaction. The solvent and any unreacted components can be removed by distillation under reduced pressure. In the preferred procedure the product is further refined by filtration.

It is believed that the reaction intermediates have the structural formula

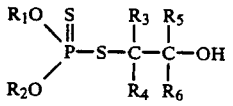

where $R_1$, $R_2$, $R_3$, $R_4$, $R_5$ and $R_6$ are herein defined above. For the reaction to proceed most efficiently, it is preferred that the intermediate be a primary or a secondary alcohol.

The intermediate is then reacted with the secondary phosphite ester, in a transesterification reaction in which there is an interchange of acyl or alkoxyl groups resulting in the formation of a different ester. The secondary phosphite ester, a diorgano phosphite, always has a hydrogen atom attached directly to the phosphorus atom and can be characterized by the structural formula

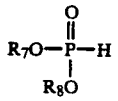

where $R_7$ and $R_8$ are hydrocarbyl radicals, usually aliphatic, containing 1 to 20 carbon atoms and more preferably 1 to 6 carbon atoms, and can additionally contain sulfur, oxygen and nitrogen. An example of a phosphite ester is dimethyl phosphite. It is believed that the phosphite products of the invention, also known as hydrogen phosphonates, have the following structure

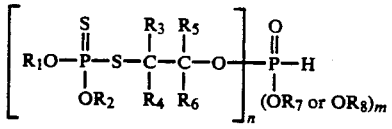

where $R_1$, $R_2$, $R_3$, $R_4$, $R_5$, $R_6$, $R_7$ and $R_8$ are described above, n is 1 to 2 and m is 0 to 1. Other structures which may be formed are:

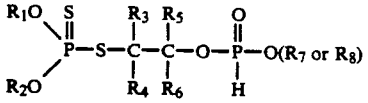

when n=1 and m=1 or

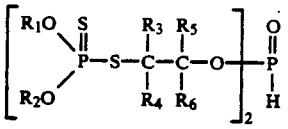

when n=2 and m=0.

The reaction, typically, takes place in the liquid phase with one of the reactants being introduced gradually. An excess of one reactant is usually used in order to enable the reaction to proceed to completion. Thus, the reactants can be contacted in proportion expressed in a molar ratio of intermediate to phosphite of 1:5 to 5:1, preferably 2:1. The reaction temperature can range from 0° to 300° C., preferably from 50° to 175° C. A catalyst, such as that of the alkali metal alkoxide type, can be employed, the preferred catalyst is titanium isopropoxide. The reactants are contacted for three to ten hours, preferably six hours.

It is believed that the effectiveness of the additives of the present invention when blended with industrial fluids is due to the synergistic activity between the phosphorodithioate group and the phosphonate group. The reaction products are useful in low concentrations and do not contain any potentially undesirable metals or corrosion promoting materials.

The contemplated automotive or industrial fluids are lubricants such as liquid oils in the form of either a mineral oil or synthetic oils or mixtures thereof and greases in which any of the foregoing oils are employed as a base. Still further materials which it is believed would benefit from the reaction products of the present invention are fuels.

In general, the additives can be blended with the lubricant in a concentration of from 0.05% to 10% by weight of the total composition. The preferred amount ranges from 0.1% to 5%. The lubricating oils contemplated are mineral oils, both paraffinic and naphthenic and mixtures thereof, and synthetic oils. The lubricant can be of any suitable lubricating viscosity range, for example, from about 45 SSU at 100° F. to about 6000 SSU at 100° F., and preferably from about 50 to 250 SSU at 210° F. The oils may have viscosity indexes ranging from up to 100 or higher. Viscosity indexes from about 70 to 95 being preferred. The average molecular weights of these oils can range from about 250 to about 800.

Where the lubricant is employed as a grease, the lubricant is generally used in an amount sufficient to balance the total grease composition, after accounting for the desired quantity of the thickening agent, and other additive components included in the grease formulation. A wide variety of materials can be employed as thickening or gelling agents. These can include any of the conventional metal salts or soaps, such as calcium, or lithium stearates or hydroxystearates, which are dispersed in the lubricating vehicle in grease-forming quantities in an amount sufficient to impart to the resulting grease composition the desired consistency. Other thickening agents that can be employed in the grease formulation comprise the non-soap thickeners, such as surface-modified clays and silicas, aryl ureas, calcium complexes and similar materials. In general, grease thickeners can be employed which do not melt or dissolve when used at the required temperature within a particular environment; however, in all other respects, any material which is normally employed for thickening or gelling hydrocarbon fluids for forming greases can be used in the present invention.

The additives are effective when used in industrial lubrication applications, such as in circulation oils and steam turbine oils where large charges of oil are expected to last the lifetime of the machinery without being replaced. Gas turbines, both heavy-duty gas turbines and aircraft gas turbines would also benefit from the lubricant additives of the present invention. The additives are believed useful in diesel engine oils, i.e., those used in marine diesel engines, locomotives, power plants and high speed automotive diesel engines. Gasoline burning engines would also benefit from the present additives. Automatic transmission fluids are another class of lubricants for which these additives are suited. These fluids represent a careful balance of properties needed to meet the unique requirements of automatic transmissions. Gear oils are another class of fluids which would benefit from the additives of the present invention. Typical of such oils are automotive spiral-bevel and worm gear axle oils which operate under extreme pressures, load and temperature conditions and hypoid gear oils which operate under both high speed, low torque and low-speed, high torque conditions. It is also desirable to employ the additive in greases. Greases containing the additive are particularly useful in automobile chassis lubrication.

The lubricating oils and greases contemplated for blending with the additive of the invention can also contain other additive materials such as corrosion inhibitors, detergents, extreme pressure agents, viscosity index improvers, friction reducers, antiwear agents and the like. Representative of these additives include, but are not limited to, phenates, sulfonates, imides, heterocyclic compounds, polymeric acrylates, amines, amides, esters, sulfurized olefins, succinimides, succinate esters, metallic detergents containing calcium or magnesium, arylamines, hindered phenols and the like.

It is also contemplated that the additives may be useful in fuels. The additives can be blended in a concentration from about 0.01% to about 10 wt. % based on the total weight of the composition. Preferably, the concentration is from 0.1 to about 5 wt. %.

When the additives are utilized in fuels, the fuels contemplated are liquid hydrocarbon and liquid oxygenated fuels such as alcohols and ethers. Liquid hydrocarbon fuels include gasoline, fuel oils, diesel oils and alcohol fuels include methyl and ethyl alcohols and ethers such as methyl tert butyl ether and tert amyl methyl ether.

Specifically, the fuel compositions contemplated include gasoline base stocks such as a mixture of hydrocarbons boiling in the gasoline boiling range which is from about 90° F. to about 450° F. This base fuel may consist of straight chain or branched chain aliphatic hydrocarbons or paraffinic hydrocarbons, cycloparaffins, olefins, aromatic hydrocarbons, or mixtures thereof. The base fuel can be derived from among others, straight run naphtha, polymer gasoline, natural gasoline or from catalytically cracked, alkylate or thermally cracked hydrocarbons and catalytically cracked reformed stock. The composition and octane level of the base fuel is not critical, and any conventional motor fuel base can be employed in the practice of this invention. Further examples of fuels of this type are petroleum distillate fuels having an initial boiling point from about 75° F. to about 135° F. and an end boiling point from about 250° F. to about 750° F. It should be noted in this respect that the term distillate fuels is not intended to be restricted to straight-run distillate fractions. These distillate fuel oils can be straight-run distillate fuel oils catalytically or thermally cracked (including hydrocracked) distillate fuel oils, etc. Moreover, such fuel oils can be treated in accordance with well-known commercial methods, such as acid or caustic treatment, dehydrogenation, solvent refining, clay treatment and the like.

Particularly contemplated among the fuel oils are Nos. 1, 2 and 3 fuel oils used in heating and as diesel fuel oils, gasoline, turbine fuels and jet combustion fuels.

The fuels may contain alcohols and/or gasoline in amounts of 0 to 50 volumes per volume of alcohol. The fuel may be an alcohol-type fuel containing over 50 volumes to little or no hydrocarbon. Typical of such fuels are methanol, ethanol and mixtures of methanol and ethanol. The fuels which may be treated with the additive include gasohols which may be formed by mixing 90 to 95 volumes of gasoline with 5 to 10 volumes of ethanol or methanol. A typical gasohol may contain 90 volumes of gasoline and 10 volumes of absolute ethanol.

The fuel compositions of the instant invention may additionally comprise any of the additives generally employed in fuel compositions. Thus, additive packages of the instant invention may additionally contain solvents, conventional carburetor detergents, anti-knock compounds such as tetraethyl lead, anti-icing additives, upper cylinder and fuel pump lubricity additives and the like.

EXAMPLE 1

Propoxylated Di-(2-Ethylhexyl) Phosohorodithioic Acid

Approximately 708.6 gm of di-(2-ethylhexyl)phosphorodithioic acid (commercially available from Stauffer Chemical Company) is charged into a 1 liter stirred reactor equipped with a condenser and a thermometer. Approximately 116.2 gm of propylene oxide (equal molar) is slowly added over a course of 2 hours. The reaction temperature is controlled at or below 40° C. by using an ice-water bath for cooling. At the end of the addition, the reaction mixture changed its color from dark greenish to light yellowish. It weighed approximately 825 gm.

EXAMPLE 2

Propoxvlated Di-(4-Methyl-2-Pentyl) Phosohorodithioic Acid

Into a four-necked flask equipped with a stirrer, condenser, dropping funnel and thermometer are added 838 g (8.2 moles) of 4-methyl-2-pentanol and the contents are heated to 60° C. At that temperature, 444.5 g (2.0 moles) of phosphorus pentasulfide are added portionwise over a three-hour period with agitation. After all of the sulfide reactant is introduced, the temperature is raised to 65° C. and held for three hours. The evolution of hydrogen sulfide gas indicates a substantially complete reaction and the hydrogen sulfide gas is trapped by a caustic scrubber. The reaction is then allowed to cool to ambient temperature under a nitrogen blanket and the solution is filtered through diatomaceous earth to produce a greenish fluid (1158.5 g) which is the desired phosphorodithioic acid.

The phosphorodithioic acid is further reacted with an equimolar amount of propylene oxide (232.4 g) following the exact procedure as described in Example 1. At the end of the reaction, the mixture changes its color to light yellowish, and excess unreacted 4-methyl-2-pentanol is removed by distillation.

EXAMPLE 3

Reaction Product of S-2-Hydroxypropyl-O,O-Di-(2-Ethylhexyl) Phosphorodithioate and Dimethyl Phosphite Approximately 206 g (0.5 mole) of the above product of Example 1 and 1.0 g of titanium isopropoxide catalyst were charged in a reaction flask, slowly 27.5 g (0.25 mole) of dimethyl phosphite is added dropwise over a period of one hour at 65° C. This mixture is then heated at 100° C. for three hours, at 120° C. for five hours, and finally at 145° C. for one hour, during which time volatiles are collected in a Dean-Stark condenser. The final solution is filtered through diatomaceous earth to produce 215 g light yellowish liquid as desired product. This product shows a distinct P-H peak at 2430 $cm^{-1}$ on its infrared spectrum.

EXAMPLE 4

Reaction Product of S-2-Hydroxypropyl O,O-Di-(4-Methyl-2-Pentyl) Phosphorodithioate and Dimethyl Phosphite Approximately 178 g (0.5 mole) of the product of Example 2 and 1.0 g of titanium isopropoxide catalyst is charged in a reaction flask slowly, 27.5 g (0.25 mole) of dimethyl phosphite is added at 65° C., and the reaction is followed according to the same procedure as described in Example 3. Finally, all volatiles are removed by vacuum distillation to leave about 185 g of a yellow fluid which is the desired product. This product shows a distinct infrared peak of P-H at 2440 $cm^{-1}$.

EVALUATION OF THE PRODUCT

The organic phosphite products of the present invention were blended in a concentration of 1 wt % in a mineral oil and evaluated for antioxidant performance in the Catalytic Oxidation Test at 325° F. for 40 hours (Table 1) and in the Catalytic Oxidation Test at 325° F. for 72 hours (Table 2).

The test procedure consisted of subjecting a volume of the test lubricant to a stream of air which was bubbled through the composition at a rate of about 5 liters per hour for the specified number of hours and at the specified temperature. Present in the test composition were metals frequently found in engines, namely:

1) 15.5 square inches of a sand-blasted iron wire;
2) 0.78 square inches of a polished copper wire;
3) 0.87 square inches of a polished aluminum wire; and
4) 0.107 square inches of a polished lead surface.

The results of the test were presented in terms of changes in kinematic viscosity (KV), change in neutralization number (TAN) and lead loss. Essentially, the small change in KV meant that the lubricant maintained its internal resistance to oxidation under high temperatures, the small change in lead loss indicated that the lubricant was not corrosive to lead under corrosive conditions, such as high temperatures and oxidizing conditions.

It will be noted that the lubricant blended with the additive compositions of the present invention attained small delta values. Thus, the compositions are effective multifunctional antioxidant additives.

The ability of the oil, containing the products of the present invention, to prevent the wearing down of metal parts under severe operating conditions was tested in the 4-Ball Wear Test. Three stationary stainless steel balls of ½ inch in diameter were placed in a container. The mineral oil lubricant containing the additive was added to the container and a fourth stainless steel ball was placed in a chuck mounted on a device which spinned the ball at 2000 RPM under 60 kg load for 30 minutes at 200° F. From the reported data (Table 3), it will be noted that the additives of the present invention exhibit good antiwear performance.

TABLE 1

| Item | Catalytic Oxidation Test 40 Hours at 325° F. Additive Conc. (wt %) | Change In Acid Number Delta TAN | Percent Change In Viscosity % Delta KV | Sludge |
|---|---|---|---|---|
| Base Oil (200 second, solvent refined, paraffinic neutral, mineral oil) | — | 4.78 | 57.9 | Heavy |
| Example 4 in above base oil | 1.0 | 2.60 | 22.0 | Heavy |

TABLE 2

| Item | Catalytic Oxidation Test 72 Hours at 325° F. Additive Conc. (wt %) | Change In Acid Number Delta TAN | Percent Change In Viscosity % Delta KV | Sludge |
|---|---|---|---|---|
| Base Oil (200 second, solvent refined, paraffinic neutral, mineral oil) | — | 9.60 | 118.9 | Heavy |
| Example 3 (in above base oil) | 1.0 | 4.41 | 38.9 | Heavy |
| Example 4 (in above base oil) | 1.0 | 8.55 | 65.2 | Heavy |

TABLE 3

| Item | Four-Ball Test (60 kg load, 2000 rpm, 30 min., 200° F.) Wear Scar Diameter (mm) |
|---|---|
| Base Oil (80% solvent paraffinic bright, 20% solvent paraffinic neutral mineral oil) | 4.15 |
| 1% Example 3 in above base oil | 0.43 |
| 1% Example 4 in above base oil | 0.57 |

What is claimed is:

1. A product of reaction having the formula:

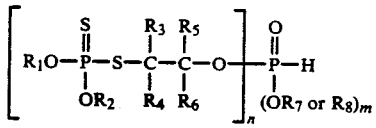

where $R_1$ and $R_2$ are hydrocarbyl having 1 to 30 carbon atoms, $R_3$, $R_4$, and $R_6$ are independently hydrogen or hydrocarbyl, containing 1 to 60 carbon atoms or contain at least one heteroatom which is oxygen, sulfur or nitrogen, $R_7$ or $R_8$ are hydrocarbyl containing 1 to 20 carbon atoms, n is an integer ranging from 1 to 2, and m is an integer ranging from 0 to 1 the sum of n and m being 2.

2. The product of claim 1 in which $R_1$ and $R_2$ are alkyl or aryl.

3. The product of claim 1 in which $R_7$ or $R_8$ is hydrocarbyl having 1 to 6 carbon atoms.

4. The product of claim 1 in which $R_1$ and $R_2$ are 4-methyl-2-pentyl or 2-ethyl-1-hexyl and $R_7$ or $R_8$ is methyl.

5. An automotive or industrial fluid composition comprising a major amount of the fluid and a minor multifunctional antioxidant and antiwear amount of a product having the formula

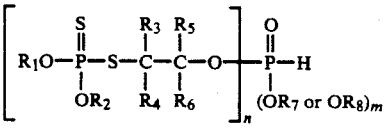

where $R_1$ and $R_2$ are hydrocarbyl having 1 to 30 carbon atoms, $R_3$, $R_4$, $R_5$ and $R_6$ are independently hydrogen or hydrocarbyl containing 1 to 60 carbon atoms or which contain at least one heteroatom which is oxygen, sulfur or nitrogen, $R_7$ or $R_8$ is hydrocarbyl containing 1 to 20 carbon atoms, n is an integer ranging from 1 to 2 and m is an integer ranging from 0 to 1 the sum of n and m being 8.

6. The composition of claim 5 in which $R_1$ and $R_2$ are alkyl or aryl.

7. The composition of claim 5 in which $R_7$ or $R_8$ is hydrocarbyl having 1 to 6 carbon atoms.

8. The composition of claim 5 in which $R_1$ and $R_2$ are 4-methyl-2-pentyl or 2-ethyl-1-hexyl and $R_7$ or $R_8$ is methyl.

9. An automotive or industrial fluid composition comprising an automotive orindustrial fluid and a reaction product having multifunctional antioxidant and antiwear properties of an intermediate reaction product of an O'O-diorganophosphorodithioic acid, and an alkylene oxide having the structural formula

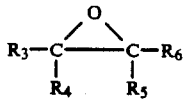

where $R_3$, $R_4$, $R_5$ and $R_6$ are independently hydrogen or hydrocarbyl containing 1 to 60 carbon atoms or contain at least one heteroatom which is oxygen, sulfur or nitrogen, the intermediate reaction product reacted with a phosphite ester having the structural formula

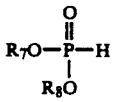

where $R_7$ and $R_8$ are hydrocarbyl containing 1 to 20 carbon atoms.

10. The composition of claim 9 in which the hydrocarbyl of the phosphite ester contains 1 to 6 carbon atoms.

11. The composition of claim 9 in which the phosphite ester is dimethyl phosphite.

12. The composition of claim 9 in which the phosphorodithioic acid is derived from alcohols having 1 to 30 carbon atoms.

13. The composition of claim 9 in which the phosphorodithioic acid is derived from 4-methyl-2-pentanol, 2-ethyl-1-hexyl alcohol, ethyl alcohol, propyl alcohol, n-butyl alcohol, isobutyl and sec-butyl alcohol, amyl alcohol, hexyl alcohol, cyclohexyl alcohol, lauryl alcohol, benzyl alcohol, phenol, cresol, xylenol, naphthol, ethylphenol, butylphenol, nonylphenol, or mixtures thereof.

14. The composition of claim 9 in which the alkylene oxide is ethylene oxide, propylene oxide, butylene oxide, cyclohexene oxide, or styrene oxide.

15. A method of making an automotive or industrial fluid composition comprising blending a major amount of an automotive or industrial fluid with a minor multifunctional antioxidant and antiwear amount of an intermediate reaction product of an O'O-diorganophosphorodithioic acid and an alkylene oxide having the structural formula

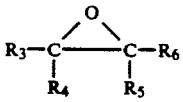

where $R_3$, $R_4$, $R_5$ and $R_6$ are independently hydrogen or hydrocarbyl containing 1 to 60 carbon atoms or contain at least one heteroatom which is oxygen, sulfur or nitrogen reacted with a phosphite ester having the structural formula

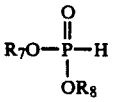

where $R_7$ and R8 are hydrocarbyl containing 1 to 20 carbon atoms.

16. The method of claim 15 in which the hydrocarbyl of the phosphite ester contains 1 to 6 carbon atoms.

17. The method of claim 15 in which the phosphite ester is dimethyl phosphite.

18. The method of claim 15 in which the phosphorodithioic acid is derived from alcohols having 1 to 30 carbon atoms.

19. The method of claim 15 in which the phosphorodithioic acid is derived from 4-methyl-2-pentanol, 2-ethyl-1-hexyl alcohol, ethyl alcohol, propyl alcohol, n-butyl alcohol, isobutyl and sec-butyl alcohol, amyl alcohol, hexyl alcohol, cyclohexyl alcohol, lauryl alcohol, benzyl alcohol, phenol, cresol, xylenol, naphthol, ethylphenol, butylphenol, nonylphenol or mixtures thereof.

20. The method of claim 15 in which the alkylene oxide is ethylene oxide, propylene oxide, butylene oxide, cyclohexene oxide, or styrene oxide.

21. A reaction product useful as a multifunctional additive to improve the antiwear and antioxidant properties of a fuel or lubricant comprising a reaction product having the structural formula

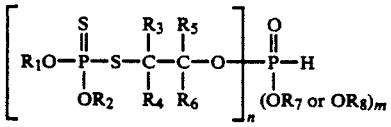

where $R_1$ and $R_2$ are hydrocarbyl radicals having 1 to 30 carbon atoms, $R_3$, $R_4$, $R_5$ and $R_6$ are hydrogen atoms or hydrocarbyl radicals containing 1 to 60 carbon atoms or contains at least one heteroatom which is oxygen, sulfur or nitrogen, $R_7$ or $R_8$ is a hydrocarbyl radical containing 1 to 20 carbon atoms, n is an integer ranging from 1 to 2 and m is an integer ranging from 0 to 1 the sum of n and m being 2.

22. The reaction product of claim 21 in which $R_1$ and $R_2$ are alkyl or aryl.

23. The reaction product of claim 21 in which $R_7$ or $R_8$ is a hydrocarbyl group having 1 to 6 carbon atoms.

24. The reaction product of claim 21 in which $R_1$ and $R_2$ are 4-methyl-2-pentyl or 2-ethyl-1-hexyl and $R_7$ or $R_8$ is methyl.

25. The composition of claim 5 in which the composition contains from 0.05 wt. % to 10 wt. % of the product based on the total weight of the composition.

26. The composition of claim 5 in which the automotive or industrial fluid is a mineral oil or synthetic oil.

27. The composition of claim 9 in which from 0.05 wt. % to 10 wt. % of the reaction product is contained in the automotive or industrial fluid based on the total weight of the composition.

28. The composition of claim 9 in which the automotive or industrial fluid is a mineral oil or synthetic oil.

29. The method of claim 15 in which from 0.05 wt. % to 10 wt. % of the reaction product is blended with the automotive or industrial fluid based on the total weight of the composition.

* * * * *

UNITED STATES PATENT AND TRADEMARK OFFICE

CERTIFICATE OF CORRECTION

PATENT NO. : 5,084,069

DATED : January 28, 1992

INVENTOR(S) : Liehpao O. Farng et al.

It is certified that error appears in the above-identified patent and that said Letters Patent is hereby corrected as shown below:

Column 8:

Claim 1, line 3 of formula, change "$(OR_7$ or $R_8)_m$" to --$(OR_7$ or $OR_8)_m$--.

Column 9:

Claim 5, line 3 of formula, change "$(OR_7$ or $R_8)_m$" to --$(OR_7$ or $OR_8)_m$--.

Claim 5, last line, change "8" to --2--.

Column 10:

Claim 21, line 3 of formula, change "$(OR_7$ or $OR_8)$" to --$(OR_7$ or $OR_8)_m$--.

Signed and Sealed this

Sixth Day of July, 1993

*Attest:*

Michael K. Kirk

MICHAEL K. KIRK

*Attesting Officer*

*Acting Commissioner of Patents and Trademarks*